US008511993B2

(12) United States Patent
Kemppainen et al.

(10) Patent No.: US 8,511,993 B2
(45) Date of Patent: Aug. 20, 2013

(54) APPLICATION OF DENSE VERTICALLY CRACKED AND POROUS THERMAL BARRIER COATING TO A GAS TURBINE COMPONENT

(75) Inventors: Dana Kemppainen, Jensen Beach, FL (US); RuthAnn Rawlings, Stuart, FL (US); Jonah Klemm-Toole, Palm Beach Gardens, FL (US); Robert Moore, Palm City, FL (US)

(73) Assignee: Alstom Technology Ltd., Baden (CH)

( * ) Notice: Subject to any disclaimer, the term of this patent is extended or adjusted under 35 U.S.C. 154(b) by 785 days.

(21) Appl. No.: 12/541,266

(22) Filed: Aug. 14, 2009

(65) Prior Publication Data

US 2011/0038710 A1 Feb. 17, 2011

(51) Int. Cl.
*F01D 5/28* (2006.01)

(52) U.S. Cl.
USPC ..... 416/97 R; 416/241 B; 416/241 R

(58) Field of Classification Search
USPC ..... 427/402, 256; 416/241 B, 241 R, 416/193 A, 97 R
See application file for complete search history.

(56) References Cited

U.S. PATENT DOCUMENTS 5,209,645 A * 5/1993 Kojima et al. ..... 416/241 B
5,840,434 A * 11/1998 Kojima et al. ..... 428/689
6,375,425 B1 * 4/2002 Lee et al. ..... 416/97 R
6,432,487 B1 8/2002 Graham et al.
6,740,364 B2 5/2004 Lau et al.
RE39,320 E * 10/2006 Nichols et al. ..... 416/241 B
7,294,413 B2 11/2007 Nagaraj et al.
7,306,859 B2 * 12/2007 Wortman et al. ..... 428/701
7,597,966 B2 * 10/2009 Spitsberg et al. ..... 428/469
8,007,246 B2 * 8/2011 Rowe et al. ..... 416/241 R
2003/0224124 A1 12/2003 Lau et al.
2004/0081760 A1 * 4/2004 Burns et al. ..... 427/269
2006/0251916 A1 * 11/2006 Arikawa et al. ..... 428/632
2008/0145694 A1 6/2008 Bucci
2009/0038935 A1 * 2/2009 Floyd et al. ..... 204/192.11

FOREIGN PATENT DOCUMENTS

EP 1219721 12/2001

* cited by examiner

*Primary Examiner* — Edward Look
*Assistant Examiner* — Liam McDowell
(74) *Attorney, Agent, or Firm* — Shook, Hardy & Bacon L.L.P.

(57) ABSTRACT

A configuration for coating a turbine component such as a blade or vane with various forms of thermal barrier coating to provide enhanced temperature capability and increased strain tolerance is disclosed. A gas path surface of the platform, airfoil and airfoil fillet region are first coated with a bond coating. A dense vertically cracked (DVC) thermal barrier coating is then applied to at least the gas path surface of the platform and can be applied to the fillet region. A porous thermal barrier coating is then applied to at least the airfoil. The porous thermal barrier coating can also be applied over the DVC thermal barrier coating if desired.

26 Claims, 5 Drawing Sheets

APPLICATION OF DENSE VERTICALLY CRACKED AND POROUS THERMAL BARRIER COATING TO A GAS TURBINE COMPONENT

TECHNICAL FIELD

The present invention generally relates to thermal barrier coatings that are applied to gas turbine components. More specifically, the present invention relates to using different forms of a thermal barrier coating for application on a gas turbine blade or vane.

BACKGROUND OF THE INVENTION

Gas turbine engines operate to produce mechanical work or thrust. Specifically, land-based gas turbine engines typically have a generator coupled thereto for the purposes of generating electricity. A gas turbine engine comprises an inlet that directs air to a compressor section, which has stages of rotating compressor blades. As the air passes through the compressor, the pressure of the air increases. The compressed air is then directed into one or more combustors where fuel is injected into the compressed air and the mixture is ignited. The hot combustion gases are then directed from the combustion section to a turbine section by a transition duct. The hot combustion gases cause the stages of the turbine to rotate, which in turn, causes the compressor to rotate.

The hot combustion gases are directed through a turbine section by turbine blades and vanes. Stationary turbine vanes precede each stage of rotating blades in order to direct the flow of hot combustion gases onto the blades at the appropriate angle to maximize turbine efficiency. These blades and vanes are subject to extremely high operating temperatures, stresses, and strains. Typical areas of high stress and strain for a blade and vane include the platform area as well as the joint between the airfoil and the platform. To help reduce the operating temperatures of the turbine blades and vanes, a cooling fluid such as air is often passed through the blade or vane and exits through the blade tip or through holes in the airfoil surface. However, cooling alone is not always sufficient or possible depending on the geometry of the blade or vane and the operating conditions of the engine.

SUMMARY

In accordance with the present invention, there is provided a novel method and configuration for coating a turbine component such as a blade or vane with various forms of thermal barrier coating which provide enhanced temperature capability and increased strain tolerance.

In an embodiment of the present invention, a gas turbine component is provided having a platform portion with a generally planar gas path surface and an airfoil extending from the platform and having a fillet region extending around a perimeter of the airfoil at the interface between the airfoil and the platform portion. The airfoil may include a plurality of cooling holes for directing a cooling fluid therethrough. A plurality of coatings are applied to the gas turbine component including a first coating applied to the airfoil, the fillet region, and the planar gas path surface of the platform portion. A second coating is applied over the first coating on the planar gas path surface and the fillet region and a third coating is applied over the first coating on the airfoil where the second coating has a greater strain tolerance than the third coating.

In an another embodiment of the present invention, a gas turbine component is provided having a first platform and a second platform that are oriented generally parallel and spaced a radial distance apart, where the first and second platforms have generally planar gas path surfaces. One or more airfoils extend between the first and second platforms and include fillet regions extending around a perimeter of the one or more airfoils at interfaces between the one or more airfoils and the platforms. A first coating is applied to the one or more airfoils, the fillet regions, and the planar gas path surfaces of the platforms followed by a second coating that is applied to the planar gas path surfaces of the platforms and the fillet regions. A third coating is applied to the one or more airfoils where the third coating has a thermal conductivity lower than a thermal conductivity of the second coating. It is permissible that the second and third coatings can overlap. Where such overlap occurs, no significant increase in coating thickness should occur.

In a further embodiment of the present invention, a gas turbine component comprises one or more platforms having a generally planar gas path surface, an airfoil extending from the one or more platforms, a fillet region extending around a perimeter of the airfoil at an interface of the airfoil and the one or more platforms. A first coating is applied to the airfoil, the fillet region, and the planar gas path surface of the one or more platforms, while a second coating applied to the planar gas path surface. A third coating is applied to the airfoil and fillet region where the third coating has a thermal conductivity lower than a thermal conductivity of the second coating.

In yet another embodiment of the present invention, a method of applying thermal barrier coatings to a turbine component is disclosed in which the component has at least one platform and an airfoil. The method comprises identifying a first, second, and third area of the turbine component requiring a bond coating and a form of thermal barrier coating. The bond coating is applied to the first, second, and third areas after which a dense vertically cracked thermal barrier coating is applied to at least the first and second areas. A porous thermal barrier coating is then applied to at least the third area. Overlap and overspray of the thermal barrier coatings is permissible as long as the turbine component is free from steps at coating transitions.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
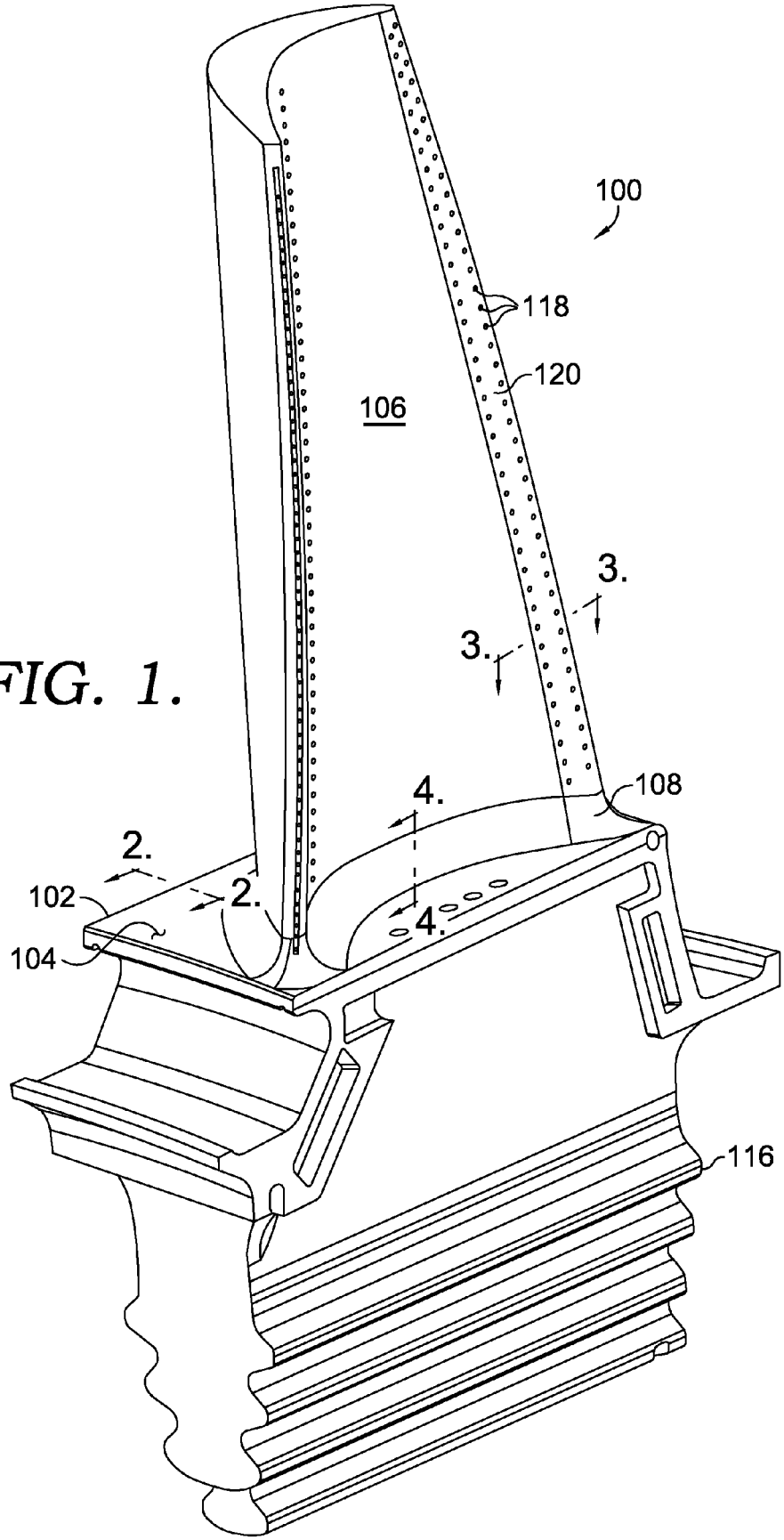
FIG. 1 is a perspective view of a turbine blade in accordance with an embodiment of the present invention.

Referring initially to FIG. 1, a gas turbine blade 100 is shown in perspective view and includes a platform portion 102 having a generally planar gas path surface 104 and an airfoil 106 extending radially outward from the platform 102. Extending around a perimeter of the airfoil 106 at an interface between the airfoil 106 and the platform 102 is a fillet region 108, which is also referred to as a transition zone. The fillet region 108 provides a smooth transition between the airfoil 106 and the platform 102 in order to reduce bending stresses at the interface. The fillet region 108 typically has a radius-like shape, but can alternatively include a compound fillet radius or variable radius, depending on the operating stresses and geometry of the turbine blade 100.

Gas turbine blades 100 are known to operate at extremely high temperatures due to the combustion gases passing through the turbine. Often times these operating conditions meet or slightly exceed the capability of the material from which the blades 100 are fabricated. In order for the turbine blade 100 to operate at such high temperatures, the blade 100 is augmented with one or more temperature-reducing features such as cooling with air or steam, application of a thermal barrier coating, or a combination of both.

In an embodiment of the present invention, a first coating 110 is applied to the airfoil 106, the fillet region 108, and the planar gas path surface 104 of the platform portion 102. The coatings as described below can be applied by a variety of processes including, but not limited to low pressure plasma spray (LPPS), physical vapor deposition (PVD), high velocity oxy-fuel (HVOF), or other similar processes.

Figure 2:
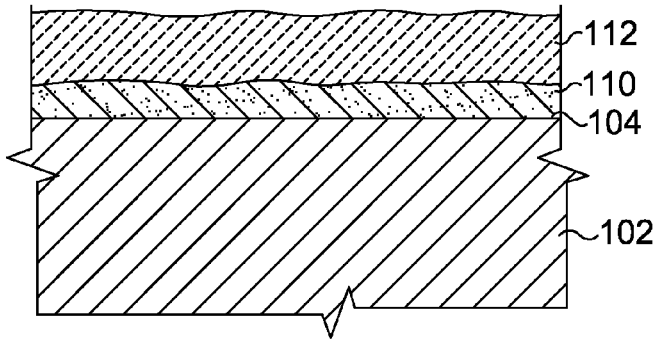
FIG. 2 is a cross section view of a portion of the turbine blade of FIG. 1 indicating a coating configuration along the platform in accordance with an embodiment of the present invention.
Figure 3A:
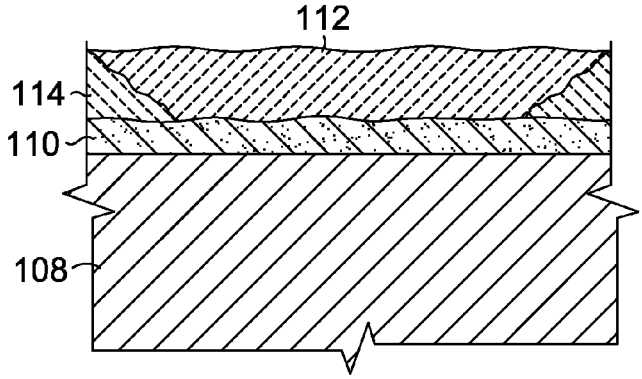
FIGS. 3A and 3B are cross section views of a portion of the turbine blade of FIG. 1 indicating coating configurations along a leading edge region in accordance with embodiments of the present invention.
Figure 3B:
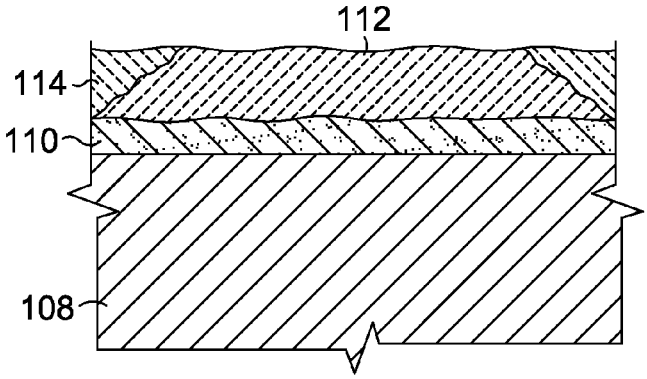
Figure 4A:
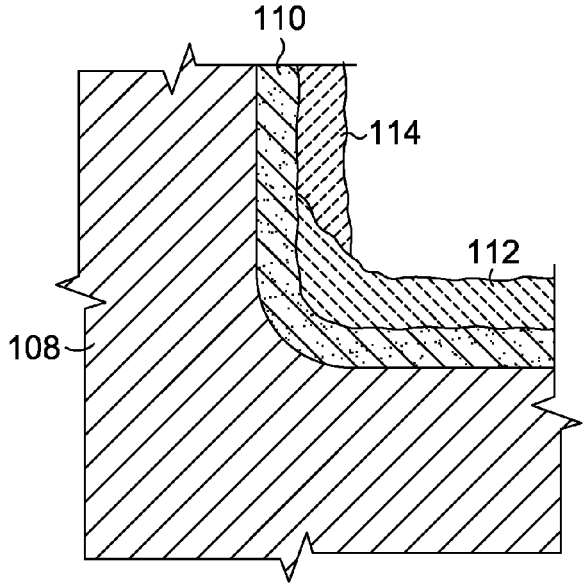
FIGS. 4A and 4B are cross section views of a portion of the turbine blade of FIG. 1 indicating various coating boundaries and interfaces along the fillet region of the turbine component in accordance with an embodiment of the present invention.
Figure 4B:
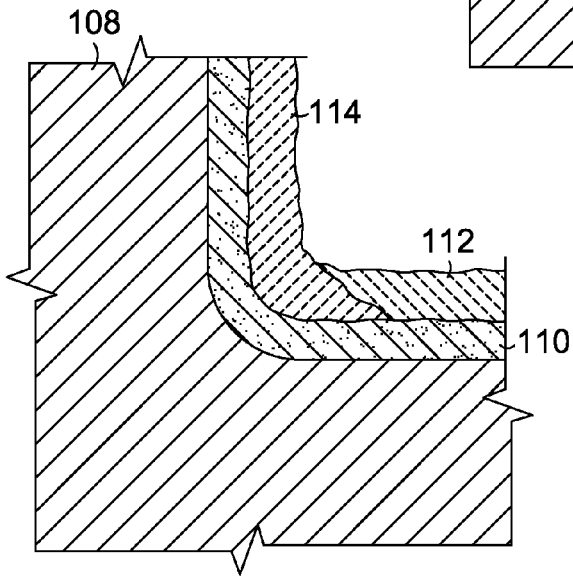
Figure 5:
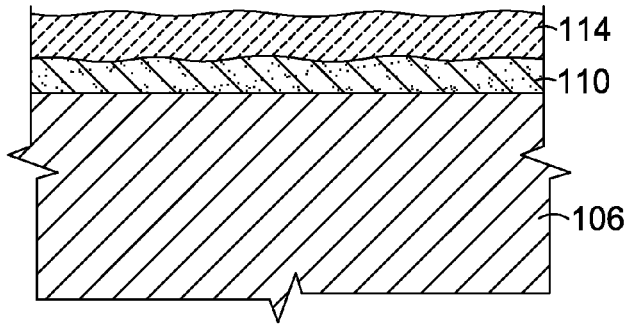
FIG. 5 is a cross section view of a portion of the turbine blade of FIG. 1 indicating a coating configuration along the airfoil in accordance with an embodiment of the present invention.

The application of the first coating 110 is depicted in FIGS. 2-5, in which a cross section of the platform portion 102 is shown in FIG. 2, views of the fillet region 108 are shown in FIGS. 4A-4B, and a cross section of the airfoil 106 is shown in FIG. 5. The first coating 110 is preferably a MCrAlXZ bond coating that is applied directly to the metal substrate of the blade 100 and has a thickness of approximately 0.003"-0.012", where M is Ni and/or Co, X can be Y, Zr, Hf, Si, and Z can be Ta, Re, or Pt. The bond coating 110 produces a surface on the blade 100 that permits an additional coating, such as a thermal barrier coating, to adhere directly thereto. For example, one such acceptable bond coating is CoNiCrAlY.

The turbine blade 100 also includes a second coating 112 which is applied to the planar gas path surface 104 and the fillet region 108. The second coating 112 is applied to these areas after the bond coating 110 has been applied to the metal substrate so the second coating will adhere to the blade 100. The second coating 112 is preferably a thermal barrier coating applied in a manner such that dense vertically-oriented micro-cracks are formed in the coating. In an embodiment of the present invention, the second coating is a 7%-9% Yttria Stabilized Zirconia that is applied approximately 0.010"-0.025" thick. For some embodiments, the second coating can be applied up to 0.040" thick. As one skilled in the art will understand, a dense vertically cracked (DVC) thermal barrier coating forms a series of microscopic vertical cracks in the coated surface which provide increased strain tolerance by way of the cracked surface while also providing thermal protection to the coated surface. The micro-cracks are formed by a high level of intersplat bonding that occurs due to the particle characteristics. The second coating has a density factor that is variable and depends on the particle characteristics such as temperature and velocity of the coating particles and temperature of the gas turbine component. Depending on how these variables are changed, the density of the cracks within the coating can be increased or decreased.

A third coating 114 is applied to the airfoil 106, over the first coating 110, and is a generally porous thermal barrier coating comprising 7%-9% Yttria Stabilized Zirconia applied approximately 0.005"-0.019" thick. In some embodiments, application of the porous thermal barrier coating can be as thick as 0.040." The thermal barrier coating is applied to the airfoil 106 to increase the thermal capability of the airfoil portion of the blade 100 in areas of lower strain and can provide the thermal benefit to the airfoil at a lower weight increase to the blade because porous thermal barrier coating can be applied thinner than the DVC to achieve the same temperature reduction. To provide similar thermal capabilities to the airfoil 106, DVC thermal barrier coating must be applied thicker than porous thermal barrier coating because of its higher thermal conductivity. Coating thickness is especially important for turbine blades because as turbine blades rotate, any weight positioned radially outward of the attachment 116 creates a pull on the attachment and corresponding stresses between the attachment 116 and associated disk (not shown). Therefore, it is desirable to minimize any weight increase to the blade 100. Where less coating can be applied, less weight is added to the blade 100, which results in reduced blade pull and lower stresses in the blade attachment 116.

With respect to porosity of the thermal barrier coatings, as the porosity increases, the thermal conductivity decreases. As such, the third coating 114 (porous thermal barrier coating) has higher porosity than the second coating (DVC thermal barrier coating) and also has lower thermal conductivity than the second coating. Furthermore, a variety of coating formulations having different porosity levels can be used, including those thermal barrier coatings having a high level of porosity (upwards of approximately 25%).

In an embodiment of the present invention, the fillet region 108, or transition zone, can have both the second and third coating applied, in no particular order. Such application can be due to overspray or intentional application, depending on the thermal conductivity required for that region of the turbine blade 100. Where coating overlap occurs, such overlap should not result in significant thickness increase. Specifically, the thickness Tt in the fillet region (transition zone) 108, is a function of the position within the transition zone and the other coating thicknesses such that $Tt=(x)Ts+(x-1)Td$ where Ts is the thickness of the porous thermal barrier coating, and Td is the thickness of the dense vertically cracked thermal barrier coating, where x is between 0 and 1.

In an embodiment of the present invention, the airfoil 106 can also have cooling holes 118 which communicate with internal cavities within the blade 100 for passing cooling air from inside the blade 100 to the external surfaces of the airfoil 106. Specifically, cooling holes 118 can have a uniform diameter or be shaped so as to provide controlled cooling to specific locations of the airfoil 106. It has been found that application of DVC thermal barrier coating to a turbine component having cooling holes causes the holes to close down because of the intersplat bonding associated with the DVC application. Masking techniques used to protect the cooling holes from DVC coating have been ineffective, resulting in large amount of time (and cost) spent removing coating from the cooling holes and re-shaping the cooling holes.

Figure 6:
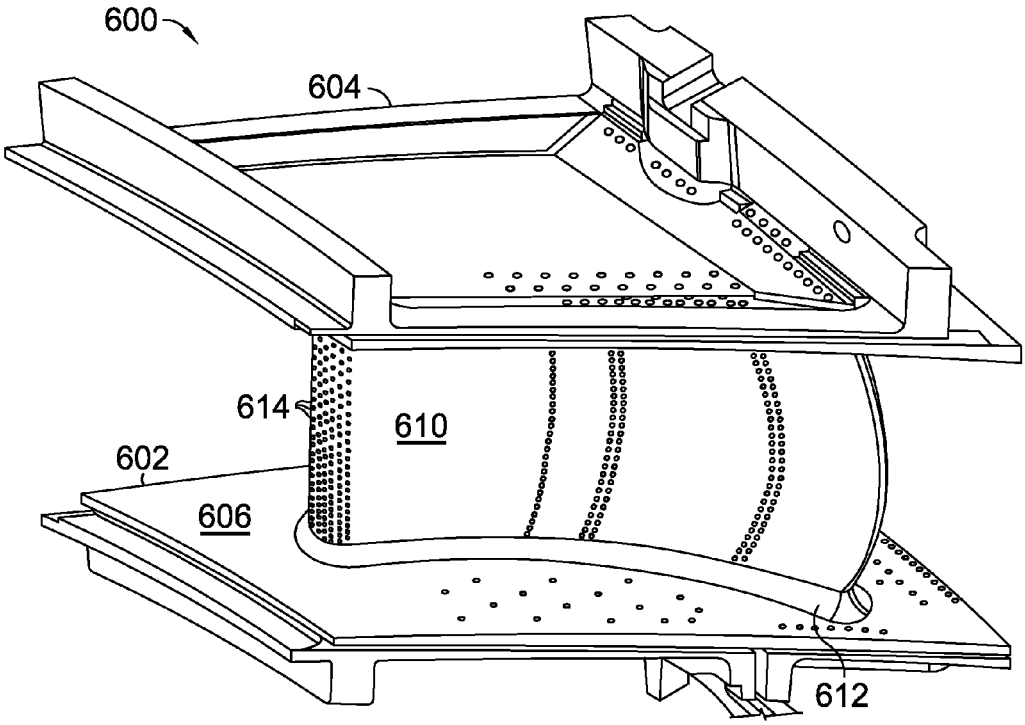
FIG. 6 is a perspective view of a turbine vane in accordance with an embodiment of the present invention.
Figure 7:
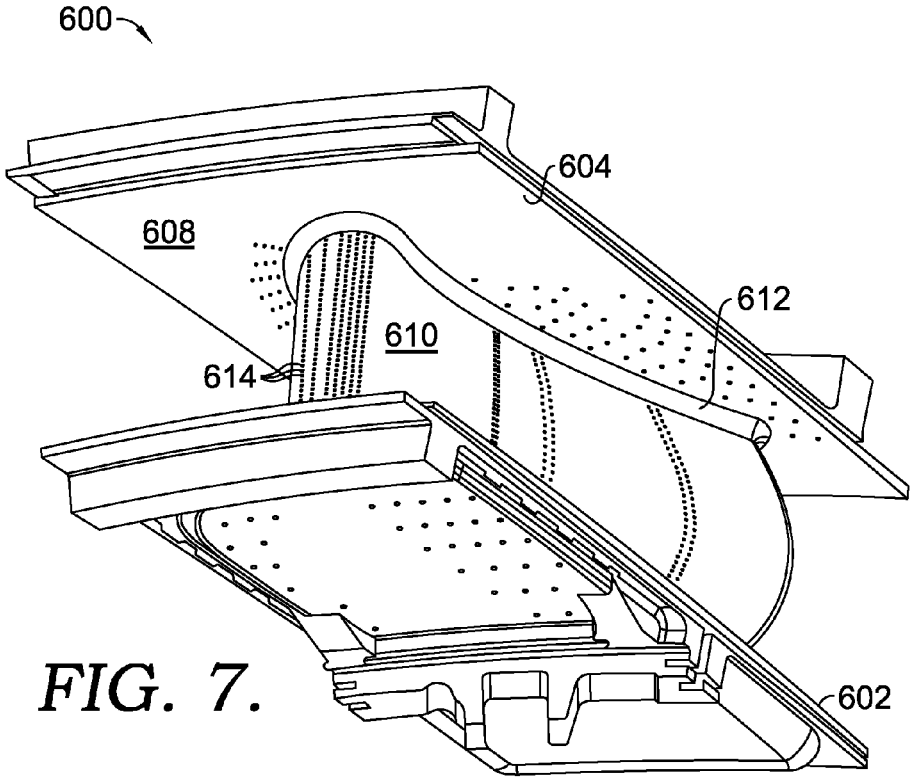
FIG. 7 is an alternate perspective view of the turbine vane of FIG. 6 in accordance with an embodiment of the present invention; and, FIG. 8 is a flow diagram depicting the coating process in accordance with an embodiment of the present invention.

Referring to FIGS. 6 and 7, an alternate embodiment of the present invention is depicted. A gas turbine vane 600 includes a first platform 602 and a second platform 604 which are oriented generally parallel and spaced a radial distance apart with the first platform 602 having a generally planar gas path surface 606 and the second platform 604 having a generally planar gas path surface 608. The vane 600 also includes one or more airfoils 610 extending radially between the first and second platforms 602 and 604. The quantity of airfoils 610 in the vane 600 can vary depending on the geometry of the vane and stage of the turbine. For the embodiment shown in FIGS. 6 and 7, a single airfoil 610 is shown. However, alternate vane configurations having multiple airfoils 610 are also possible. A fillet region 612 extends around the perimeter of the airfoil 610 at interfaces between the airfoil 610 and the platforms 602 and 604.

The vane 600 also includes a plurality of coatings to compensate for elevated operating temperatures. A first coating, or MCrAlXZ bond coating that is applied directly to the metal substrate of the vane 600 and has a thickness of approximately 0.003"-0.012", where M is Ni and/or Co, X can be Y, Zr, Hf, Si, and Z can be Ta, Re, or Pt. The bond coating, is applied to the one or more airfoils 610, the fillet regions 612, and the planar gas path surfaces 606 and 608. A second coating comprising 7%-9% Yttria Stabilized Zirconia 0.010"-0.025" thick is applied to the bond coating of the planar gas path surfaces 606 and 608 as well as the fillet regions 612. The second coating is applied as previously discussed such that dense vertically-oriented micro-cracks are formed in the coating to provide durability to high strain areas of the platforms 602 and 604 and fillet regions 612.

A third coating having a thermal conductivity lower than that of the second coating is applied to the one or more airfoils 610. The third coating comprises a porous thermal barrier coating of 7%-9% Yttria Stabilized Zirconia applied 0.005"-0.019" thick. Depending on the operating conditions, thermal barrier coating on turbine vanes can be thicker, up to 0.040."

Depending on the operating conditions of the gas turbine engine, the vane 600 can include a plurality of cooling holes 614. The cooling holes 614 may have a uniform diameter or may also be shaped to control the direction and velocity of the cooling fluid used to cool the airfoil 610. Application of the porous thermal barrier coating to the airfoil 610 instead of the DVC thermal barrier coating reduces potential closing of the cooling holes 614.

In an alternate embodiment of the present invention, a gas turbine component is disclosed having one or more platforms 102, each with a generally planar gas path surface 104, and an airfoil 106 extending from the platform 102. A fillet region 108 extends around the perimeter of the airfoil 106 at the interface with the one or more platforms 102. A first coating (bond coating) is applied to the airfoil 106, the fillet region 108, and the gas path surface 104 of the platforms 102. A second coating (dense vertically cracked thermal barrier coating) is applied to the planar gas path surfaces 104, while a third coating (porous thermal barrier coating) is applied to the airfoil 106 and fillet region 108. Such a coating configuration can be utilized when the higher strain capability provided by the dense vertically cracked thermal barrier coating is not required because of lower strain rates in the fillet region 108.

In an alternate embodiment, the airfoil 106 can also include multiple forms of the thermal barrier coating. Referring back to FIG. 1, a fourth area 120 is located generally along a leading edge of the airfoil 106 and can be coated with the dense vertically cracked thermal barrier coating 112 in lieu of the porous thermal barrier coating 114. This configuration is shown in FIGS. 3A and 3B. Applying the dense vertically cracked thermal barrier coating 112 to the leading edge portion 120 of the airfoil can extend the airfoil life because the dense vertically cracked thermal barrier coating is more resistant to erosion, which is a common life-limiting factor of turbine blades and vanes due to the impact of various particles and debris on the leading edge 120.

Figure 8:
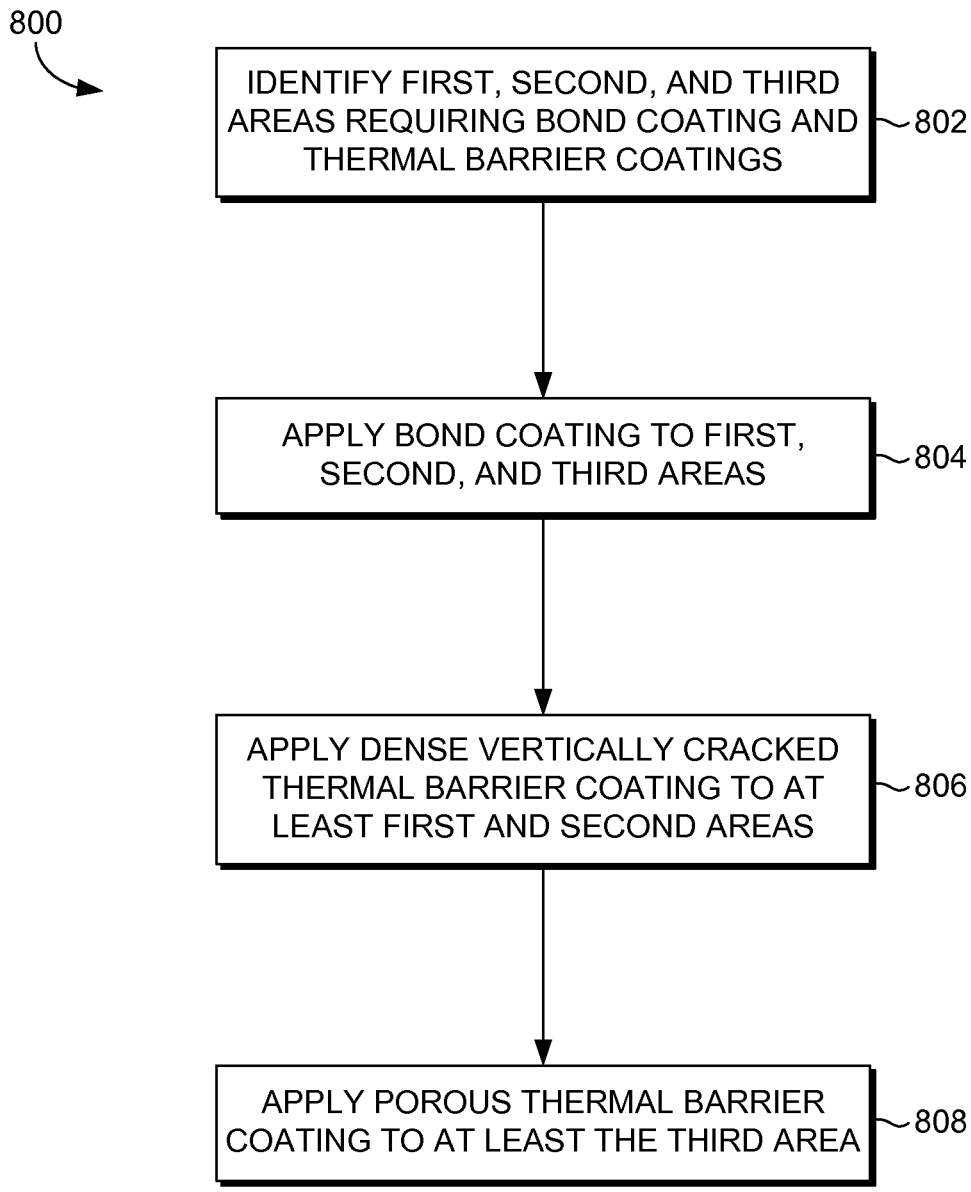

In yet another embodiment of the present invention, a method 800 of applying thermal barrier coatings to a turbine component is disclosed in FIG. 8 in which the turbine component has at least one platform and an airfoil. In a step 802, first, second, and third areas of the turbine component requiring a bond coating and thermal barrier coating are identified. The first area is generally a gas path surface of the platform, and the second area is a fillet region extending around a perimeter of the airfoil proximate an end of the airfoil at the interface of the airfoil and gas path surface of the platform, while the third area is the outer surface of the airfoil. Areas not to be coated can then be masked to prevent unwanted overspray from the coating process. In a step 804, a bond coating is applied to the first, second, and third areas. Once the bond coating has been applied to the desired surfaces of the turbine component in a step 806, a dense vertically cracked thermal barrier coating is applied to the desired areas, such as at least the first and second areas. In a step 708, a porous thermal barrier coating is applied to the desired areas such as at least the third area. It should be noted that the dense vertically cracked coating can be applied prior to or after the porous thermal barrier coating.

The plurality of coatings described herein are applied in such a manner so as to eliminate any definitive steps between adjacent coated surfaces. While there may be slight areas of overspray, either intentional or as a result of the coating process, it is desired that there is generally a uniform transition that occurs between all coated areas of the turbine component. A generally uniform transition prevents any disruption of the hot combustion gas flow passing along the gas path surfaces of the turbine blade or vane. In an embodiment of the present invention, overspray of the thermal barrier coating is permitted such that the porous thermal barrier coating is also applied to a portion of the second area (and onto the DVC thermal barrier coating) as depicted in FIGS. 4A and 4B.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A method of applying thermal barrier coatings to a turbine component having at least one platform and an airfoil, the method comprising:

identifying a first, second, and third areas of the turbine component requiring a bond coating and a thermal barrier coating;

applying the bond coating to the first, second, and third areas;

applying directly over the bond coating of the first area only a dense vertically cracked thermal barrier coating;

applying directly over the bond coating of the second area a dense vertically cracked thermal barrier coating; and, applying directly over the bond coating of the third area only a porous thermal barrier coating to the third area.

2. The method of claim 1, wherein a generally uniform transition occurs between the coatings applied to the first, second, and third areas.

3. The method of claim 1, wherein the first area is a gas path surface of the platform.

4. The method of claim 3, wherein the second area is a fillet region extending around a perimeter of the airfoil proximate an end of the airfoil at an interface of the airfoil and the gas path surface of the platform.

5. The method of claim 4, wherein the third area is an outer surface of the airfoil.

6. The method of claim 1, further comprising applying the porous thermal barrier coating to at least a portion of the second area such that the porous thermal barrier coating is oversprayed onto the dense vertically cracked thermal barrier coating.

7. The method of claim 1, further comprising identifying a fourth area located along a leading edge of the airfoil and applying the dense vertically cracked thermal barrier coating to the fourth area in lieu of the porous thermal barrier coating.

8. A gas turbine component comprising:

a platform portion having a generally planar gas path surface;

an airfoil extending from the platform;

a fillet region extending around a perimeter of the airfoil at an interface of the airfoil and the platform portion;

a first coating applied to the airfoil, the fillet region, and the planar gas path surface of the platform portion;

only a second coating applied directly over the first coating on the planar gas path surface;

the second coating applied directly over the first coating on the fillet region; and, only a third coating applied directly over the first coating on the airfoil;

wherein the third coating has a thermal conductivity lower than a thermal conductivity of the second coating.

9. The gas turbine component of claim 8, wherein the airfoil further comprises a plurality of cooling holes.

10. The gas turbine component of claim 8, wherein the first coating is a CoNiCrAlY bond coating applied to a metal substrate of the gas turbine component.

11. The gas turbine component of claim 8, wherein the second coating is a thermal barrier coating applied to the bond coating such that dense vertically-oriented micro-cracks are formed in the coating to provide improved durability to high strain areas of the gas turbine component.

12. The gas turbine component of claim 11, wherein the dense vertically-oriented micro-cracks have a density factor that is variable based on coating particle temperature, velocity, and temperature of the gas turbine component such that strain tolerance and cohesive strength of the second coating is variable.

13. The gas turbine component of claim 11, wherein the second coating is a 7%-9% Yttria Stabilized Zirconia applied approximately 0.010"-0.025" thick.

14. The gas turbine component of claim 8, wherein the third coating is a porous thermal barrier coating.

15. The gas turbine component of claim 14, wherein the third coating is a 7%-9% Yttria Stabilized Zirconia applied approximately 0.005"-0.019" thick.

16. The gas turbine component of claim 8, wherein the third coating has a higher porosity than the second coating.

17. A gas turbine component comprising:

one or more platforms having a generally planar gas path surface;

an airfoil extending from the platform;

a fillet region extending around a perimeter of the airfoil at an interface of the airfoil and the one or more platforms;

a first coating applied to the airfoil, the fillet region, and the planar gas path surface of the one or more platforms;

only a second coating applied directly over the first coating of the planar gas path surface;

a third coating applied directly over the first coating of the fillet region and, only the third coating applied directly over the first coating of the airfoil;

wherein the third coating has a thermal conductivity lower than a thermal conductivity of the second coating.

18. The gas turbine component of claim 17, wherein the airfoil further comprises a plurality of cooling holes.

19. The gas turbine component of claim 17, wherein the first coating is a MCrAlXZ bond coating applied to a metal substrate of the gas turbine component, where M is Ni and/or Co, X is selected from the group comprising Y, Zr, Hf, and Si, and Z is one of Ta, Re, or Pt.

20. The gas turbine component of claim 17, wherein the second coating is a thermal barrier coating applied to the bond coating such that dense vertically-oriented micro-cracks are formed in the coating to provide improved durability to high strain areas of the gas turbine component.

21. The gas turbine component of claim 17, wherein the third coating is a porous thermal barrier coating.

22. A gas turbine component comprising:

a first platform and a second platform oriented generally parallel and spaced a radial distance apart, the first and second platforms having generally planar gas path surfaces;

one or more airfoils extending between the first and second platforms;

fillet regions extending around a perimeter of the one or more airfoils at interfaces of the one or more airfoils and the platforms;

a first coating applied to the one or more airfoils, the fillet regions, and the planar gas path surfaces of the platforms;

only a second coating applied directly over the first coating of the planar gas path surfaces of the platforms;

the second coating applied directly over the first coating of the fillet regions; and, only a third coating applied directly over the first coating of the one or more airfoils;

wherein the third coating has a thermal conductivity lower than a thermal conductivity of the second coating.

23. The gas turbine component of claim 22, wherein the one or more airfoils have a plurality of shaped cooling holes.

24. The gas turbine component of claim 23, wherein the first coating is a CoNiCrAlY bond coating applied to a metal substrate of the gas turbine component.

25. The gas turbine component of claim 22, wherein the second coating is a thermal barrier coating of 7%-9% Yttria Stabilized Zirconia approximately 0.010"-0.025" thick applied to the bond coating such that dense vertically-oriented micro-cracks are formed in the coating to provide durability to high strain areas of the gas turbine component.

26. The gas turbine component of claim 22, wherein the third coating is a porous thermal barrier coating of 7%-9% Yttria Stabilized Zirconia applied approximately 0.005"-0.019" thick.

* * * * *